US012497977B2

(12) United States Patent
Lee et al.

(10) Patent No.: US 12,497,977 B2
(45) Date of Patent: Dec. 16, 2025

(54) ELECTRIC WATER PUMP

(71) Applicant: COAVIS, Sejong-si (KR)

(72) Inventors: Hyun Tae Lee, Sejong-si (KR); Woo Keun Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/760,346

(22) Filed: Jul. 1, 2024

(65) Prior Publication Data

US 2025/0012293 A1 Jan. 9, 2025

(30) Foreign Application Priority Data

Jul. 4, 2023 (KR) ..... 10-2023-0086632

(51) Int. Cl.

| | |
|---|---|
| ***F04D 29/42*** | (2006.01) |
| ***F04D 1/00*** | (2006.01) |
| ***F04D 1/06*** | (2006.01) |
| ***F04D 13/06*** | (2006.01) |
| ***F04D 13/14*** | (2006.01) |
| ***F04D 17/16*** | (2006.01) |
| ***F04D 25/16*** | (2006.01) |
| ***F04D 29/043*** | (2006.01) |
| ***F04D 29/44*** | (2006.01) |
| ***F04D 29/58*** | (2006.01) |

(52) U.S. Cl.

CPC ..... *F04D 29/4293* (2013.01); *F04D 1/006* (2013.01); *F04D 1/06* (2013.01); *F04D 13/06* (2013.01); *F04D 13/14* (2013.01); *F04D 17/162* (2013.01); *F04D 25/16* (2013.01); *F04D 29/043* (2013.01); *F04D 29/424* (2013.01); *F04D 29/426* (2013.01); *F04D 29/445* (2013.01); *F04D 29/447* (2013.01); *F04D 29/588* (2013.01)

(58) Field of Classification Search

CPC ..... F04D 13/14; F04D 13/06; F04D 1/006; F04D 29/4293; F04D 29/426; F04D 29/445; F04D 25/16; F04D 29/424; F04D 17/162; F04D 1/06

See application file for complete search history.

(56) References Cited

U.S. PATENT DOCUMENTS

| | | | | |
|---|---|---|---|---|
| 5,246,336 A * | 9/1993 | Furukawa | ..... | F04D 13/14 415/102 |
| 9,188,128 B2 | 11/2015 | Lee et al. | | |
| 10,280,924 B2 * | 5/2019 | Hökby | ..... | F04D 29/22 |
| 2013/0136628 A1 | 5/2013 | Lee et al. | | |

FOREIGN PATENT DOCUMENTS

| | | |
|---|---|---|
| KR | 10-1305671 B1 | 9/2013 |

* cited by examiner

*Primary Examiner* — Peter J Bertheaud

(74) *Attorney, Agent, or Firm* — DICKINSON WRIGHT PLLC

(57) ABSTRACT

The present invention provides an electric water pump in which a plurality of inlets and outlets for the distribution of fluid are provided in one housing, and the fluid is pumped into each space by an rotational operation of one impeller in a state where a space is partitioned for each inlet and outlet through which the fluid is distributed, thereby distributing the fluid through multiple paths with one water pump and reducing costs and weight through structure simplification.

10 Claims, 7 Drawing Sheets

ELECTRIC WATER PUMP

CROSS-REFERENCE TO RELATED APPLICATIONS

This application claims priority under 35 U.S.C. § 119 to Korean Patent Application No. 10-2023-0086632, filed on Jul. 4, 2023, in the Korean Intellectual Property Office, the disclosure of which is incorporated herein by reference in its entirety.

TECHNICAL FIELD

The following disclosure relates to an electric water pump, and more particularly, to an electric water pump that includes a plurality of channels through which fluid is distributed in one water pump, allowing fluid to be distributed through multiple paths with only one water pump and reducing costs and weight through structural simplification.

BACKGROUND

Mobility is provided with a water pump that circulates a cooling medium to parts to be cooled, thereby cooling each part.

The conventional water pump applied to vehicles is configured to always operate and circulate coolant when an engine is operating, regardless of the temperature conditions of the engine. Accordingly, a discharge flow rate of the water pump increases linearly in proportion to an engine speed, and the engine is super-cooled during the warm-up stage, so a warm-up speed of the engine is delayed.

In other words, the water pump has a problem in that, to prevent engine overheating and protect cooling system components, the discharge flow rate is set under maximum output (high speed/high load) conditions, and even under low load conditions, the discharge flow rate increases linearly, delaying the temperature rise time during the engine warm-up stage and causing unnecessary cooling.

Accordingly, the electric water pump operated by driving of a motor is being applied. This electric water pump can control the discharge flow rate as it operates by the driving of the motor, but since a single path for distributing the cooling medium is applied, the driving efficiency of the electric water pump is not sufficiently secured.

In addition, when forming an additional path for distributing a separate cooling medium to the electric water pump, there is a problem in that an internal structure becomes complicated and a volume also increases.

The contents described as the related art have been provided only for assisting in the understanding for the Background of the present invention and should not be considered as corresponding to the related art known to those skilled in the art.

RELATED ART DOCUMENT

Patent Document (Patent Document 1) KR 10-1305671 B1 (Sep. 2, 2013)

SUMMARY

An embodiment of the present invention is directed to providing an electric water pump that includes a plurality of channels through which fluid is distributed in one water pump, allowing fluid to be distributed through multiple paths with only one water pump, and reducing cost and weight through structural simplification.

In one general aspect, an electric water pump includes: a housing partitioned into a distribution space where fluid is distributed and a driving space where a motor is built, the distribution space having a plurality of inlets and outlets communicating with an outside; and an impeller provided in the distribution space of the housing and connected to the motor to rotate, formed so that the distribution space is partitioned for each inlet and outlet that communicate with each other among the plurality of inlets and outlets, and pumping the fluid to each inlet and outlet when rotating by driving of the motor.

The housing may be separately composed of a case and a cover, an upper portion of the case may be opened upward to form a portion of the distribution space, and form a driving space with a built-in motor at a lower side, and a lower portion of the cover may be opened to form the rest of the distribution space and is coupled to an upper portion of the housing.

The distribution space may be partitioned into a first distribution part on the case side and a second distribution part on the cover side by the impeller.

The case may be formed with the first distribution part that is recessed along an outer side of the distribution space, and the cover may be formed with the second distribution part that is recessed along the outer side of the distribution space.

The case may be formed with a first inlet and a first outlet communicating with the first distribution part, and the cover may be formed with a second inlet and a second outlet communicating with the second distribution part.

The first inlet and the first outlet may be symmetrically spaced apart in the first distribution part, and the second inlet and the second outlet may be symmetrically spaced apart from on an opposite side to the first inlet and the first outlet in the second distribution part.

The impeller may include a body part connected to the motor, and a guide part that rotates with the body part in the first distribution part and the second distribution part, and the guide part may partition the first distribution part and the second distribution part and, when rotating, pump a cooling medium distributed in the first distribution part and a cooling medium distributed in the second distribution part.

The motor may be provided with a driving shaft, and the driving shaft may penetrate through the upper portion of the case and the body part of the impeller to be rotatably supported by the cover, and the body part of the impeller may be coupled to the driving shaft and rotates together.

The guide part of the impeller may include a partition wall part that extends to an outer side of the body part and partitions the first distribution part and the second distribution part, and a wing part that extends upward and down from the partition wall part and is located in the first distribution part and the second distribution part.

The guide part may be provided with a rim part extending upward and downward at an end of the partition wall part, and the wing part may be formed to be connected to the rim part.

The plurality of wing parts may be formed along the partition wall part, and extend obliquely from the partition wall part.

A first recess part in which the rim part is located on the outer side of the first distribution part may be formed in the case, a second recess part in which the rim part is located on the outer side of the second distribution part may be formed in the cover, and the first recess part and the second recess part may match each other.

DETAILED DESCRIPTION OF EMBODIMENTS

Figure 1:
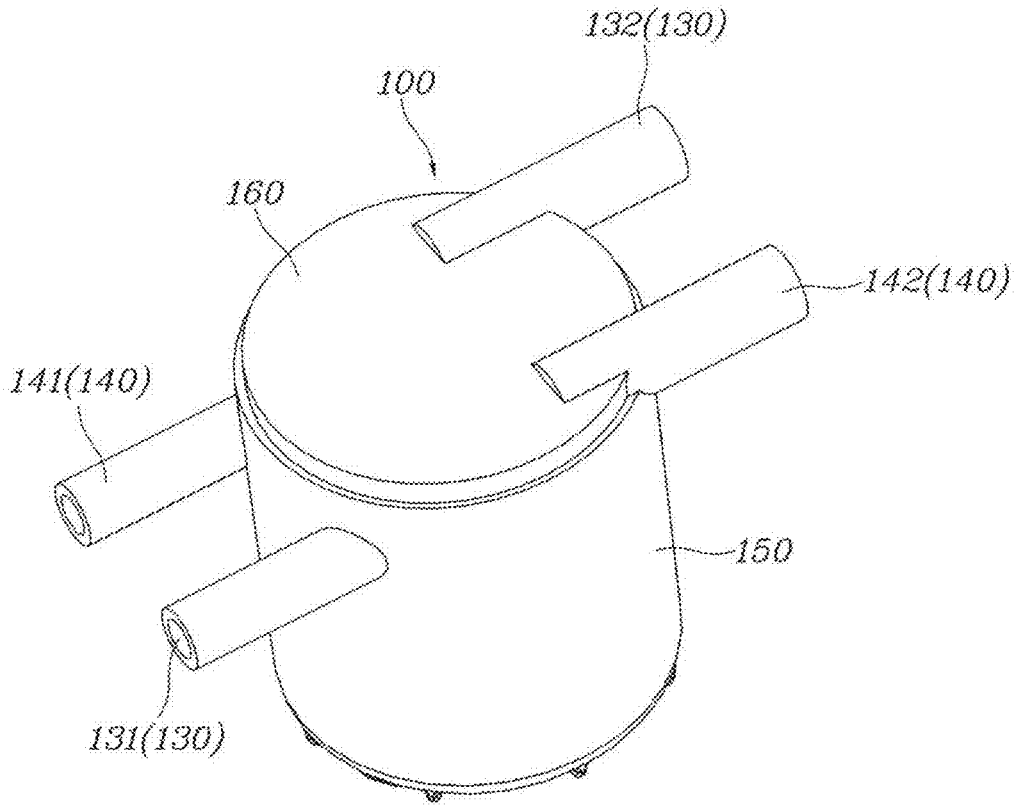
FIG. 1 is a diagram illustrating an electric water pump according to an embodiment of the present invention.

Hereafter, embodiments of the present disclosure will be described in detail with reference to the accompanying drawings and the same or similar components are given the same reference numerals regardless of the numbers of figures and are not repeatedly described.

In addition, terms "module" and "unit" for components used in the following description are used only to easily make the disclosure. Therefore, these terms do not have meanings or roles that distinguish from each other in themselves.

In the following description, if it is decided that the detailed description of known technologies related to the present invention makes the subject matter of the embodiments described herein unclear, the detailed description is omitted. Further, it should be understood that the accompanying drawings are provided only in order to allow exemplary embodiments of the present disclosure to be easily understood, and the spirit of the present disclosure is not limited by the accompanying drawings, but includes all the modifications, equivalents, and substitutions included in the spirit and the scope of the present disclosure.

Terms including ordinal numbers such as "first," "second," etc., may be used to describe various components, but the components are not to be construed as being limited to the terms. The terms are used only to distinguish one component from another component.

It is to be understood that when one element is referred to as being "connected to" or "coupled to" another element, it may be connected directly to or coupled directly to another element or be connected to or coupled to another element, having the other element intervening therebetween. On the other hand, it should be understood that when one element is referred to as being "connected directly to" or "coupled directly to" another element, it may be connected to or coupled to another element without the other element interposed therebetween.

Singular forms are intended to include plural forms unless the context clearly indicates otherwise.

It should be further understood that terms "include" or "have" used in the present specification specify the presence of features, numerals, steps, operations, components, parts mentioned in the present specification, or combinations thereof, but do not preclude the presence or addition of one or more other features, numerals, steps, operations, components, parts, or combinations thereof.

A controller may include a communication device that communicates with other controllers or sensors to control functions in charge, memory that stores an operating system, logic instructions, input/output information, etc., and one or more processors that perform judgments, calculations, decisions, etc., necessary to control the functions in charge.

Hereinafter, an electric water pump according to an exemplary embodiment of the present invention will be described with reference to the accompanying drawings.

Figure 2:
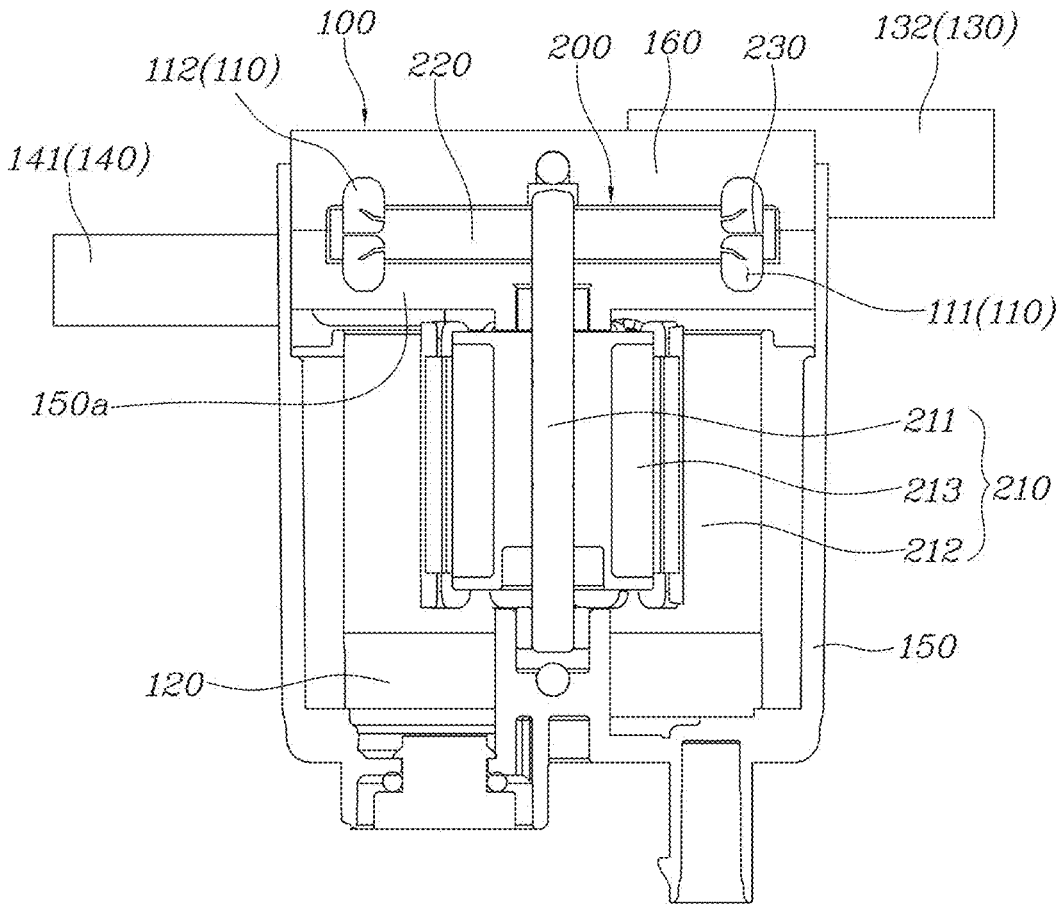
FIG. 2 is a cross-sectional view of the electric water pump illustrated in FIG. 1.

As illustrated in FIGS. 1 and 2, the electric water pump according to the present invention includes a housing 100 partitioned into a distribution space 110 where fluid is distributed and a driving space 120 into which a motor 210 is built, the distribution space 110 having a plurality of inlets 130 and outlets 140 communicating with an outside, and an impeller 200 provided in the distribution space 110 of the housing 100 and connected to the motor 210 to rotate, formed so that the distribution space 110 is partitioned for each inlet 130 and outlet 140 that communicate with each other among the plurality of inlets 130 and outlets 140, and pumping the fluid to each inlet 130 and outlet 140 when rotating by driving of the motor 210.

In the present invention, the fluid may be coolant.

An inside of the housing 100, which forms the exterior of the electric water pump, is partitioned into the distribution space 110 and the driving space 120. The distribution space 110 are provided with the plurality of inlets 130 and outlets 140 so that fluid may be distributed inside and outside the distribution space 110, and is provided with the impeller 200 The motor 210 is provided in the driving space 120. The motor 210 is connected to the impeller 200 and the impeller 200 rotates by the rotational power of the motor 210. The motor 210 may be operated under the control of a controller.

The housing 100 may be formed to prevent the fluid of the distribution space 110 from moving to the driving space 120 by partitioning the distribution space 110 and the driving space 120 but sealing the rest except the portion where the motor 210 and the impeller 200 are connected.

In particular, the housing 100 of the present invention has the plurality of inlets 130 and outlets 140 formed in the distribution space 110, and the impeller 200 is formed to partition the distribution space 110 for each inlet 130 and outlet 140 that communicate with each other among the plurality of inlets 130 and outlet 140, and as a result, the distribution space 110 is partitioned into a plurality of spaces by the impeller 200. That is, the distribution space 110 of the housing 100 is partitioned into the plurality of spaces by the impeller 200, and a pair of inlet 130 and outlet 140 is provided for each space, so the fluid may be distributed into each space.

In addition, when the impeller 200 rotates by driving the motor 210, the fluid in the distribution space 110 partitioned into the plurality of spaces by the impeller 200 is simultaneously pumped, so the fluid may be distributed through multiple paths connected to each inlet 130 and outlet 140 by one impeller 200.

As described above, according to the electric water pump, the plurality of inlets 130 and outlets 140 for the distribution of the fluid are provided in one housing 100, and the fluid is pumped into each space by the rotational operation of one impeller 200 in a state where the space is partitioned for each inlet 130 and outlet 140 through which the fluid is distributed, thereby distributing the fluid through multiple paths with one water pump and reducing the costs and weight through the structure simplification.

Describing the above-described present invention in detail, as illustrated in FIGS. 2 to 5, the housing 100 may be separated into a case 150 and a cover 160, the upper portion of the case 150 may be opened upward to form a portion of the distribution space 110, a driving space 120 with a built-in motor 210 may be formed at a lower side, and the lower portion of the cover 160 may be opened to form the rest of the distribution space 110 and may be coupled to the upper portion of the housing 100.

In this way, the housing 100 may be manufactured separately from the case 150 and the cover 160, and the internal parts including the motor 210 and the impeller 200 may be assembled and then coupled to each other.

A panel part 150*a* may be further provided in the upper portion of the case 150, and the panel part 150*a* may be formed to partition the distribution space 110 and the driving space 120 when assembled inside the case 150. This panel part 150*a* may be manufactured separately from the case 150, and after the motor 210 is built into the driving space 120, may be coupled to the case 150 to seal the driving space 120. Accordingly, the upper portion of the case 150 may become the panel part 150*a*.

In this way, the upper portion of the case 150 is opened upward to form a portion of the distribution space 110, and the lower portion of the cover 160 coupled to the upper side of the case 150 is opened downward to form the rest of the distribution space 110. In this way, when the case 150 and the cover 160 are coupled, the distribution space 110 may be formed on the inside, and the impeller 200 may be provided in the distribution space 110 and connected to the motor 210.

In the present invention, the distribution space 110 inside the housing 100 is partitioned into the plurality of spaces by the impeller 200. That is, the distribution space 110 may be partitioned into the first distribution part 111 on the case 150 side and the second distribution part 112 on the cover 160 side by the impeller 200. In this way, the impeller 200 provided in the distribution space 110 is partitioned into the distribution space 110 into the first distribution part 111 on the case 150 side and the second distribution part 112 on the cover 160 side according to its shape and may be formed to simultaneously pump the fluid in the first distribution part 111 and the fluid in the second distribution part 112 when rotating.

In addition, the case 150 is formed with a first inlet 131 and a first outlet 141 communicating with the first distribution part 111, and the cover 160 is formed with a second inlet 132 and a second outlet 142 communicating with the second distribution part 112.

That is, in the distribution space 110 inside the housing 100, the first distribution part 111 is formed on the case 150 side by the impeller 200, and the second distribution part 112 is formed on the cover 160 side. The first distribution part 111 is formed with the first inlet 131 and the first outlet 141 so that the fluid is circulated in the first distribution part 111, and the second distribution part 112 is provided with the second inlet 132 and the second outlet 142 so that the fluid is circulated in the second distribution part 112.

Accordingly, the first inlet 131 and the first outlet 141 are formed on the case 150, the second inlet 132 and the second outlet 142 are formed on the cover 160. When the case 150 and the cover 160 are coupled, the plurality of inlets 130 and outlets 140 may be provided in the housing 100. Accordingly, the distribution space 110 inside the housing 100 is partitioned into the first distribution part 111 and the second distribution part 112, and as the fluid is circulated in the first distribution part 111 through the first inlet 131 and the first outlet 141 and the fluid is circulated in the second distribution part 112 through the second inlet 132 and the second outlet 142, the fluids managed at different temperatures may be circulated through different paths.

Meanwhile, the case 150 may be recessed along the outer side of the distribution space 110 to form the first distribution part 111, and the cover 160 may be recessed along the outer side of the distribution space 110 to form the second distribution part 112.

That is, the upper portion of the case 150 is recessed along the outer side of the distribution space 110 and the first distribution part 111 extends upward and downward, so the first distribution part 111 is divided into a portion where the impeller 200 is located and a recessed empty space. In this way, when the impeller 200 rotates, the fluid moves together with the impeller 200 in the first distribution part 111, and the fluid moves up and down to the portion where the impeller 200 is located and the recessed empty space, so the fluid is pumped according to the rotational direction of the impeller 200. In this way, the fluid moving with the impeller 200 in the first distribution part 111 may be discharged under high pressure by being pumped by the generation of vortices by the up and down movement.

Similarly, the lower portion of the cover 160 is recessed along the outer side of the distribution space 110 and the second distribution part 112 extends upward and downward, so the second distribution part 112 is divided into the portion where the impeller 200 is located and the recessed empty space. In this way, when the impeller 200 rotates, the fluid moves together with the impeller 200 in the second distribution part 112, and the fluid moves up and down to the portion where the impeller 200 is located and the recessed empty space, so the fluid is pumped according to the rotational direction of the impeller 200.

Meanwhile, the first inlet 131 and the first outlet 141 are symmetrically spaced apart from the first distribution part 111, and the second inlet 132 and the second outlet 142 may be symmetrically spaced apart on an opposite side of the first inlet 131 and the first outlet 141 in the second distribution part 112.

As can be seen in FIG. 1, the first inlet 131 and the first outlet 141 are symmetrically spaced apart from the first distribution part 111, so the fluid flowing into the first distribution part 111 through the first inlet 131 may be pumped along the radius of rotation of the first distribution part 111 by the rotation of the impeller 200 and then discharged through the first outlet 141.

In addition, the second inlet 132 and the second outlet 142 are disposed on opposite sides of the first inlet 131 and the first outlet 141 so as not to interfere with the first inlet 131 and the first outlet 141. In addition, the second inlet 132 and the second outlet 142 are symmetrically spaced apart from the second distribution part 112, so the fluid flowing into the second distribution part 112 through the second inlet 132 may be pumped along the radius of rotation of the second distribution part 112 by the rotation of the impeller 200 and then discharged through the second outlet 142.

In addition, the first inlet 131 and the second inlet 132 are disposed to cross each other and the rotational direction of the impeller 200 and the direction of fluid introduced into each distribution part through the first inlet 131 and the second inlet 132 match, so the fluid introduced into the first distribution part 111 and the second distribution part 112, respectively, may be pumped using one impeller 200.

Figure 6:
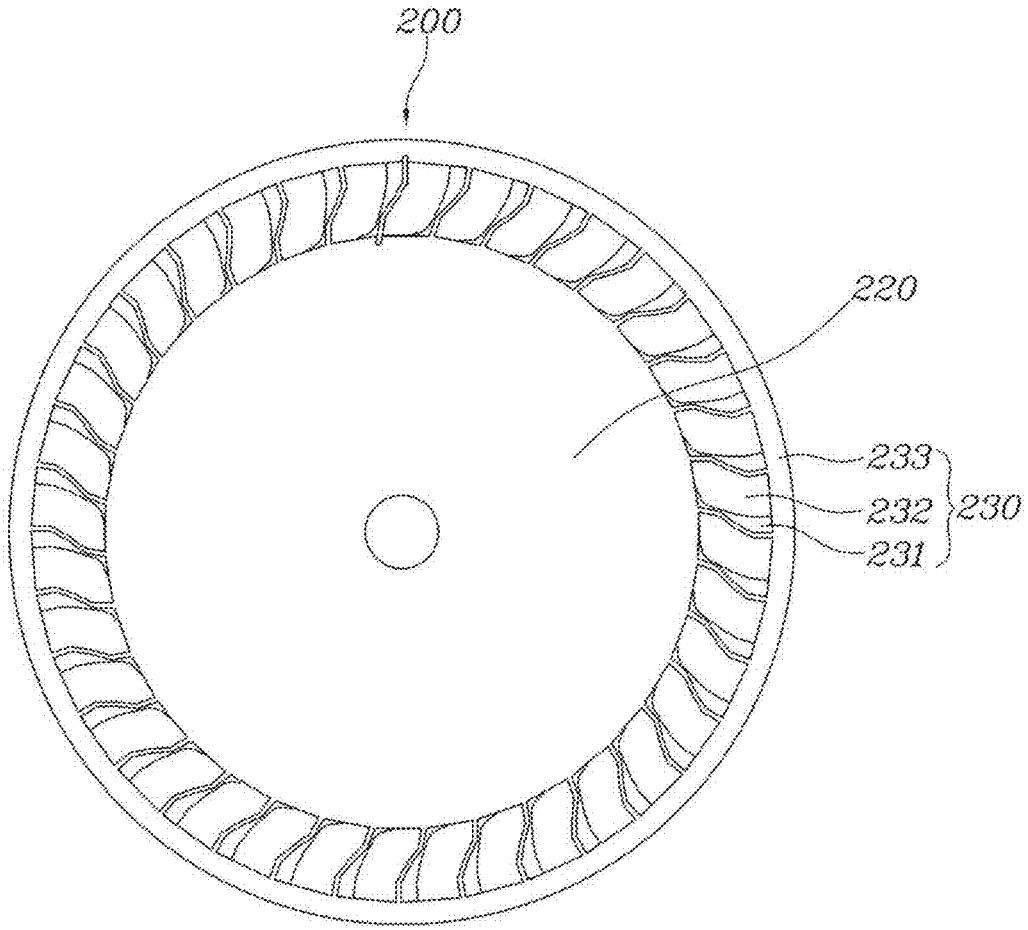
FIG. 6 is a diagram illustrating an impeller of the present invention.
Figure 7:
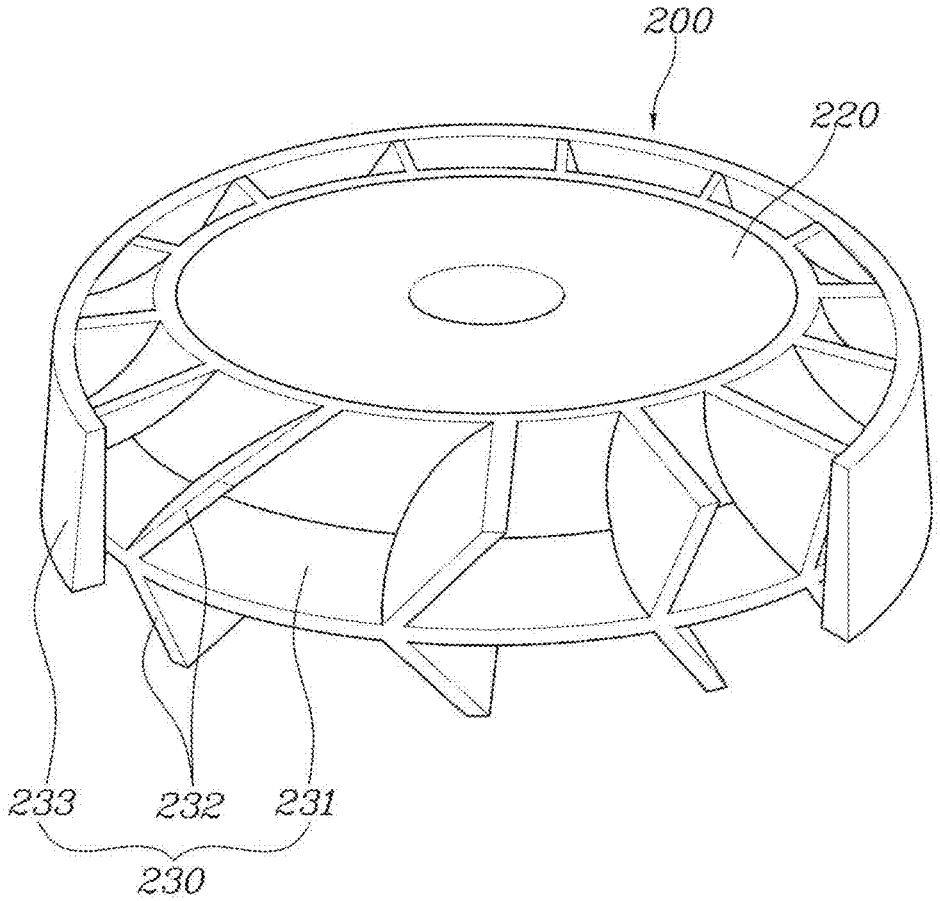
FIG. 7 is a diagram for describing the impeller of the present invention.

Meanwhile, as illustrated in FIGS. 2, 6, and 7, the impeller 200 is provided with a body part 220 connected to the motor 210 and a guide part 230 that rotates with the body part 220 in the first distribution part 111 and the second distribution part 112, so the guide part 230 may partition the first distribution part 111 and the second distribution part 112 and pump the cooling medium distributed in the first distribution part 111 and the cooling medium distributed in the second distribution part 112 when rotating.

In this way, the impeller 200 is composed of the body part 220 and the guide part 230. Here, the body part 220 is connected to the motor 210 and rotates by receiving the rotational force of the motor 210. In addition, the guide part 230 is integrally coupled with the body part 220 and rotates together, and is formed to partition the distribution space 110 into the first distribution part 111 and the second distribution part 112. In addition, the guide part 230 is formed to pump the fluid circulated in the first distribution part 111 and the second distribution part 112, so that when the impeller 200 rotates, the fluid in each distribution part may move by the pumping in the state where the fluid distributed in the first distribution part 111 and the second distribution part 112 is partitioned.

In detail, the motor 210 is provided with the driving shaft 211, and the driving shaft 211 penetrates through the upper portion of the case 150 and the body part 220 of the impeller 200 to be rotatably supported by the cover 160, and the body part 220 of the impeller 200 is coupled to the driving shaft 211 to rotate together.

As can be seen in FIG. 2, the motor 210 provided in the driving space 120 of the housing 100 is composed of a stator 212 and a rotor 213, and the driving shaft 211 is coupled to the rotor 213 to rotate. The driving shaft 211 penetrates through the upper portion of the case 150 and the body part 220 of the impeller 200 and is coupled to the body part 220 of the impeller 200 to rotate the impeller 200 together with the driving shaft 211. In addition, the driving shaft 211 penetrates through the body part 220 of the impeller 200 and the extended end is rotatably supported by the cover 160, thereby preventing the driving shaft 211 from being twisted and performing the stable rotation operation. Accordingly, a bearing structure may be applied to the cover 160 at the portion where the driving shaft 211 is connected, and the cross-sectional shape of the portion where the driving shaft 211 and the body part 220 of the impeller 200 are coupled to each other are formed to be angled, so the driving shaft 211 and the body part 220 may rotate together when assembled. In addition, the driving shaft 211 and the impeller 200 may be integrally coupled.

The guide part of the impeller 200 may include a partition wall part 231 that extends to the outer side of the body part 220 and partitions the first distribution part 111 and the second distribution part 112, and a wing part 232 that extends upward and downward from the partition wall part 231 and is located in the first distribution part 111 and the second distribution part 112.

That is, as the impeller 200 should partition the first distribution part 111 and the second distribution part 112 and pump the fluid circulated in the first distribution part 111 and the second distribution part 112, the guide part 230 is composed of the partition wall part 231 and the wing part 232.

The partition wall part 231 of the guide part 230 is formed to horizontally cross the distribution space 110 of the housing 100 to partition the first distribution part 111 and the second distribution part 112, and the wing part 232 extends upward and downward from the partition wall part 231, so, when the impeller 2100 rotates by the wing part 232 located in the first distribution part 111 and the wing part 232 located in the second distribution part 112, the fluid in each distribution part may be pumped by the wing part 232.

Here, the wing part 232 is composed of the plurality of wings along the partition wall part 231 and extends obliquely from the partition wall part 231, so the wing part 232 may forcibly transfer fluid when the impeller 200 rotates.

Figure 3:
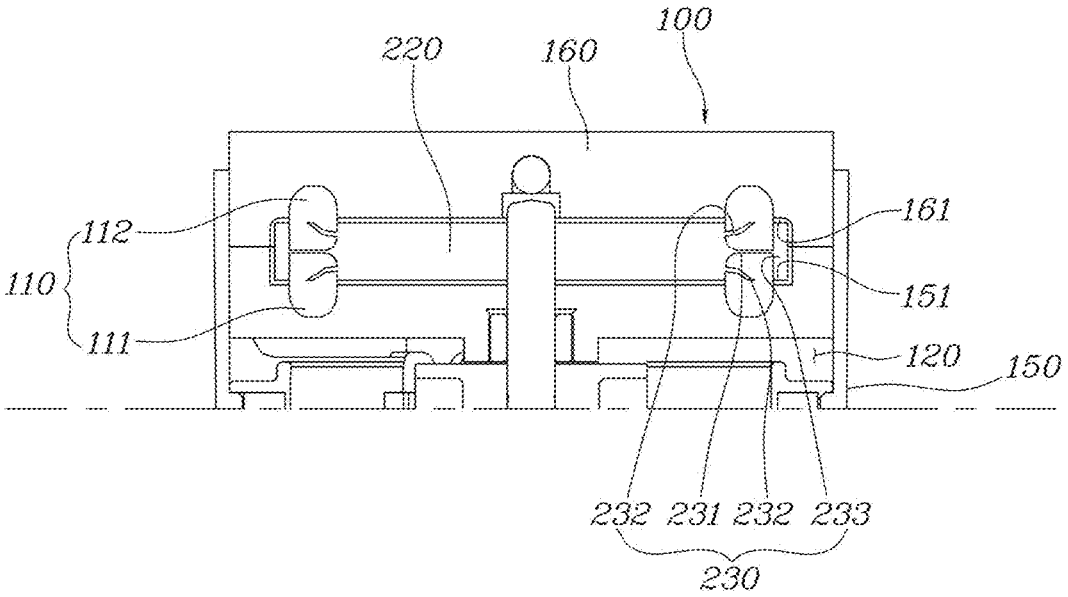
FIG. 3 is a diagram illustrating a distribution space of a housing in the electric water pump illustrated in FIG. 1.
Figure 4:
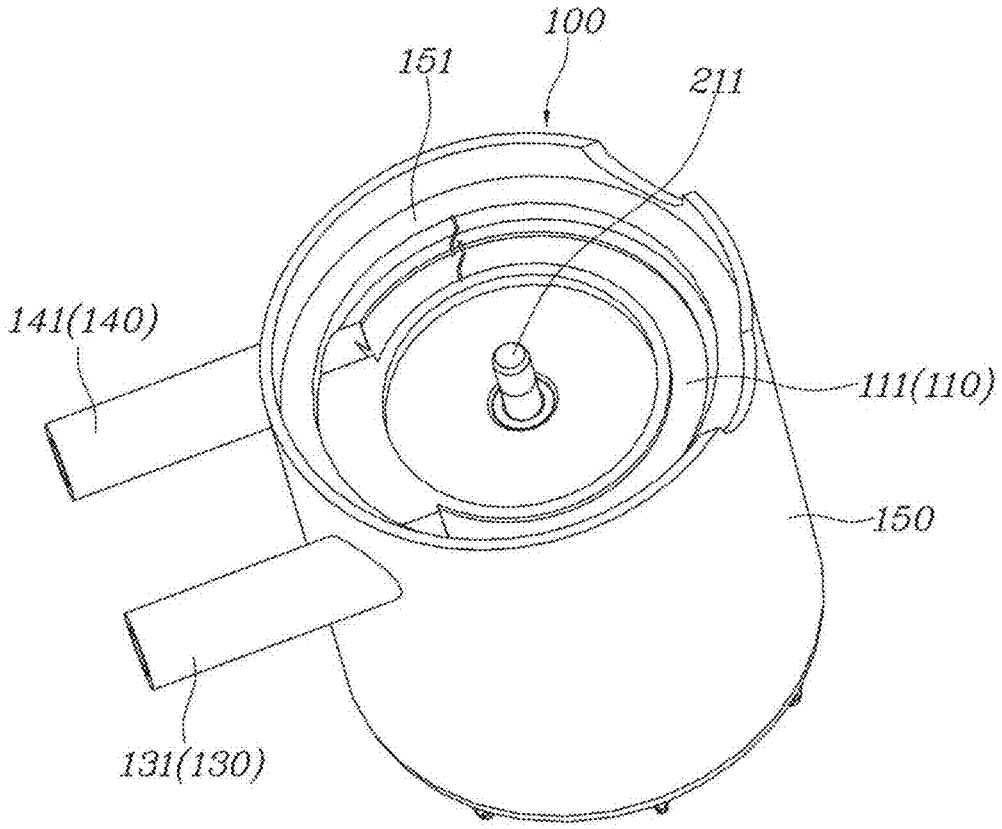
FIG. 4 is a view illustrating a case and a first distribution part of the housing according to the present invention.
Figure 5:
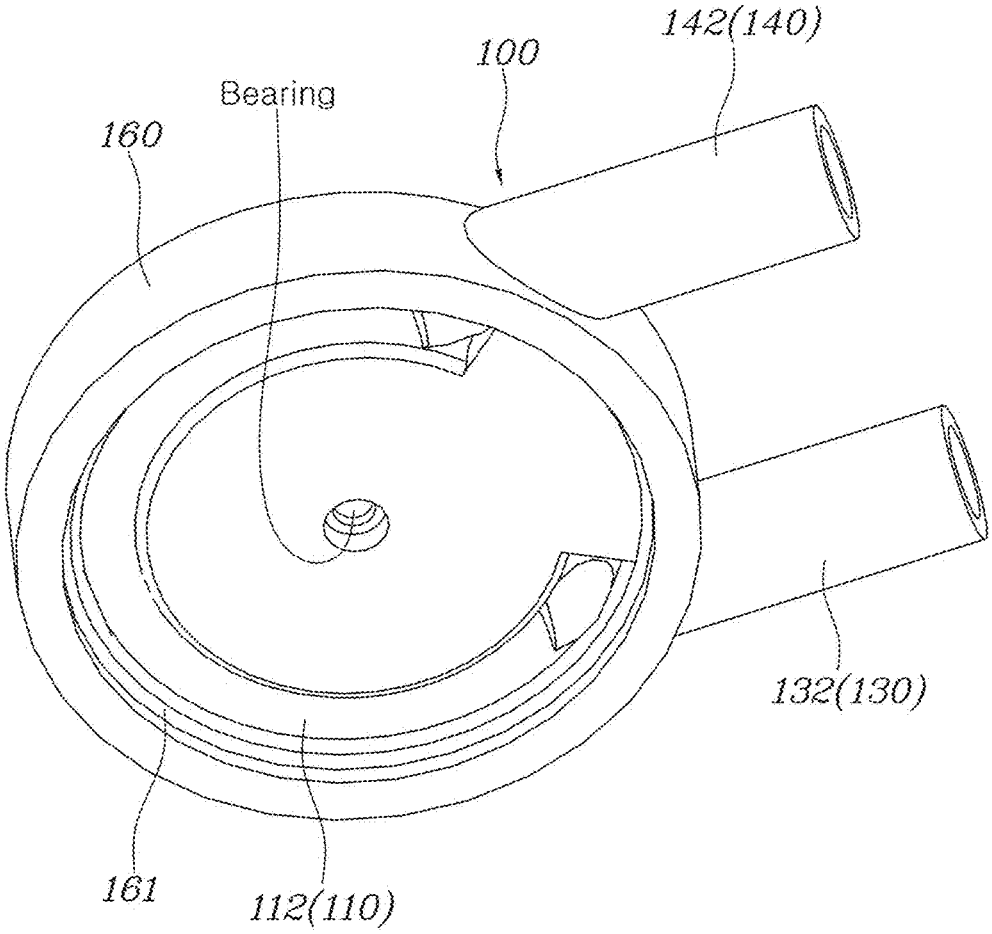
FIG. 5 is a view illustrating a cover of the housing and a second distribution part according to the present invention.

That is, as illustrated in FIGS. 3 and 7, the wing part 232 may extend obliquely from the partition wall part 231 in the rotational direction of the impeller 200, and the plurality of wing parts 232 may be composed at regular intervals along the circumferential direction of the partition wall part 231. Through this, when the impeller 200 rotates, the fluid is forcibly transferred between each wing part 232, and the fluid is forcibly transferred due to the inclined shape of the wing part 232, so the fluid may move up and down in each distribution part to generate a vortex and may be pumped under the high pressure.

In addition, the guide part 230 may be formed so that a rim part 233 extending upward and downward is formed at the end of the partition wall part 231 and the wing part 232 is connected to the rim part 233.

In this way, the rim part 233 vertically extending upward and downward is formed at the end of the partition wall part 231 in the guide portion 230, and the rim part 233 is disposed adjacent to the housing 100 or is formed to rotatably contact the housing 100, so the rotation of the impeller 200 may be stabilized.

The wing part 232 extending from the partition wall part 231 may be connected to the rim part 233 to secure the robustness of the wing part 232, and when the impeller 200 rotates at high speed, the rim part 233 may be pumped stably and its durability may also be improved.

The guide part 230 of the impeller 200 may be integrally manufactured with the partition wall part 231, the wing part 232, and the rim part 233, and when the impeller 200 rotates, the fluid between the body part 220, the partition wall part 231, the wing part 232, and the rim part 233 flows, thereby making it possible to pump the fluid by the generation of the vortex.

Meanwhile, a first recess part 151 in which the rim part 233 is located on the outer side of the first distribution part 111 is formed in the case 150, the cover 160 is formed with a second recess part 161 in which the rim part 233 is located on the outer side of the second distribution part 112, and the first recess part 151 and the second recess part 161 may match with each other.

As can be seen in FIG. 3, since the case 150 is formed with the first recess part 151 recessed from the first distribution part 111 to the outer side, the lower portion of the rim part 233 is located in the first recess part 151, so the rim part 233 does not interfere with the first distribution part 111. In addition, the first recess part 151 is formed to match the lower portion of the rim part 233, so the lower portion of the rim part 233 may be rotatably supported by the first recess part 151.

Since the second recess part 161 recessed from the second distribution part 112 to the outer side is formed even in the cover 160, the upper portion of the rim part 233 is located in the second recess part 161, so the rim part 233 does not interfere with the second distribution part 112. In addition, the second recess part 161 is formed to match the upper portion of the rim part 233, so the upper portion of the rim part 233 may be rotatably supported by the second recess part 161.

Through this, when the case 150 and the cover 160 are coupled, the rim part 233 of the impeller 200 is located between the first recess part 151 of the case 150 and the second recess part 161 of the cover 160 and the rim part 233 is rotatably supported by the first recess part 151 and the second recess part 161, so the rotational operation of the impeller 200 may be stabilized.

In this way, the impeller 200 according to the present invention is composed of a single unit, and the distribution space 110 is partitioned into the first distribution part 111 and the second distribution part 112, so the fluid moving through different paths may be pumped simultaneously in the first distribution part 111 and the second distribution part 112.

As described above, the electric water pump having the structure as described above, the plurality of inlets 130 and outlets 140 for the distribution of the fluid are provided in one housing 100, and the fluid is pumped into each space by the rotational operation of one impeller 200 in a state where the space is partitioned for each inlet 130 and outlet 140 through which the fluid is distributed, thereby distributing the fluid through multiple paths with one water pump and reducing the costs and weight through the structure simplification.

Although the present invention has been illustrated and described with respect to specific exemplary embodiments, it will be obvious to those skilled in the art that the present invention may be variously modified and altered without departing from the spirit and scope of the present invention as defined by the following claims.

What is claimed is:

1. An electric water pump, comprising:

a housing partitioned into a distribution space where fluid is distributed and a driving space into which a motor is built, the distribution space having a plurality of inlets and outlets communicating with an outside; and an impeller provided in the distribution space of the housing and connected to the motor to rotate, formed so that the distribution space is partitioned for each inlet and outlet that communicate with each other among the plurality of inlets and outlets, and pumping the fluid to each inlet and outlet when rotating by driving of the motor, wherein the housing is separately composed of a case and a cover, an upper portion of the case is opened upward to form a portion of the distribution space, and form a driving space with the built-in motor at a lower side, and a lower portion of the cover is opened to form the rest of the distribution space and is coupled to an upper portion of the case, wherein the distribution space is partitioned into a first distribution part on the case side and a second distribution part on the cover side by the impeller, wherein the case is formed with the first distribution part that is recessed along an outer side of the distribution space, and the cover is formed with the second distribution part that is recessed along the outer side of the distribution space.

2. The electric water pump of claim 1, wherein the case is formed with a first inlet and a first outlet communicating with the first distribution part, and the cover is formed with a second inlet and a second outlet communicating with the second distribution part.

3. The electric water pump of claim 2, wherein the first inlet and the first outlet are symmetrically spaced apart in the first distribution part, and the second inlet and the second outlet are symmetrically spaced apart from on an opposite side to the first inlet and the first outlet in the second distribution part.

4. The electric water pump of claim 1, wherein the impeller includes a body part connected to the motor, and a guide part that rotates with the body part in the first distribution part and the second distribution part, and the guide part partitions the first distribution part and the second distribution part and, when rotating, pumps a cooling medium distributed in the first distribution part and a cooling medium distributed in the second distribution part.

5. The electric water pump of claim 4, wherein the motor is provided with a driving shaft, and the driving shaft penetrates through the upper portion of the case and the body part of the impeller to be rotatably supported by the cover, and the body part of the impeller is coupled to the driving shaft and rotates together.

6. The electric water pump of claim 4, wherein the guide part of the impeller includes a partition wall part that extends to an outer side of the body part and partitions the first distribution part and the second distribution part, and a wing part that extends upward and downward from the partition wall part and is located in the first distribution part and the second distribution part.

7. The electric water pump of claim 6, wherein the guide part is provided with a rim part extending upward and downward at an end of the partition wall part, and the wing part is formed to be connected to the rim part.

8. The electric water pump of claim 7, wherein a first recess part in which the rim part is located on the outer side of the first distribution part is formed in the case, a second recess part in which the rim part is located on the outer side of the second distribution part is formed in the cover, and the first recess part and the second recess part match each other.

9. The electric water pump of claim 6, wherein the plurality of wing parts are formed along the partition wall part, and extend obliquely from the partition wall part.

10. An electric water pump, comprising:

a housing partitioned into a distribution space where fluid is distributed and a driving space into which a motor is built, the distribution space having a plurality of inlets and outlets communicating with an outside; and an impeller provided in the distribution space of the housing and connected to the motor to rotate, formed so that the distribution space is partitioned for each inlet and outlet that communicate with each other among the plurality of inlets and outlets, and pumping the fluid to each inlet and outlet when rotating by driving of the motor, wherein the housing is separately composed of a case and a cover, an upper portion of the case is opened upward to form a portion of the distribution space, and form a driving space with the built-in motor at a lower side, and a lower portion of the cover is opened to form the rest of the distribution space and is coupled to an upper portion of the case, wherein the distribution space is partitioned into a first distribution part on the case side and a second distribution part on the cover side by the impeller, wherein the impeller includes a body part connected to the motor, and a guide part that rotates with the body part in the first distribution part and the second distribution part, and the guide part partitions the first distribution part and the second distribution part and, when rotating, pumps a cooling medium distributed in the first distribution part and a cooling medium distributed in the second distribution part.

* * * * *